United States Patent [19]

Kluge

[11] Patent Number: 4,673,333

[45] Date of Patent: Jun. 16, 1987

[54] FUEL SUPPLY PUMP

[75] Inventor: Hermann Kluge, Ingersheim, Fed. Rep. of Germany

[73] Assignee: SWF Auto-Electric GmbH, Bissingen, Fed. Rep. of Germany

[21] Appl. No.: 749,315

[22] Filed: Jun. 26, 1985

[30] Foreign Application Priority Data

Jul. 4, 1984 [DE] Fed. Rep. of Germany ..... 3424520

[51] Int. Cl.[4] ..... F04D 5/00

[52] U.S. Cl. ..... 415/213 T; 415/168; 415/219 C

[58] Field of Search ..... 415/53 T, 198.2, 168, 415/219 C, 213 T; 417/366, 423 R

[56] References Cited

U.S. PATENT DOCUMENTS

| | | | |
|---|---|---|---|
| 3,658,444 | 4/1972 | Rhodes et al. | 415/53 T X |
| 3,881,839 | 5/1975 | MacManus | 415/53 T |
| 4,408,952 | 10/1983 | Schweinfurter | 415/53 T |
| 4,538,958 | 9/1985 | Takei et al. | 415/53 T |

FOREIGN PATENT DOCUMENTS

| | | | |
|---|---|---|---|
| 725637 | 8/1942 | Fed. Rep. of Germany | 415/53 T |
| 747947 | 3/1944 | Fed. Rep. of Germany | 415/53 T |
| 1094594 | 12/1960 | Fed. Rep. of Germany | 415/53 T |

*Primary Examiner*—Robert E. Garrett
*Assistant Examiner*—Joseph M. Pitko
*Attorney, Agent, or Firm*—James B. Raden; William J. Michals

[57] ABSTRACT

A fuel injection pump volatiling fuel which has an inlet opening to a pump chamber, an impeller in the pump chamber and a side channel, at whose end an outlet opening is provided. The outlet opening is separated from the beginning of the side channel by a sealing surface having a vent hole. To improve the supply properties of fuel with higher temperature the outlet opening has two areas extending across finite angles which are adjacent to each other in the circumferential direction. The areas have radially differing widths and extend farther into the sealing surface with the narrower area externally than internally. The supply quantity of fuel with a higher temperature is accordingly increased.

17 Claims, 6 Drawing Figures

FUEL SUPPLY PUMP

BACKGROUND OF THE INVENTION

The present invention relates to a fuel supply pump, which is particularly suitable for easily volatiling fuel.

A supply pump having features of this kind is known from the 13th edition of the book "Die Pumpen" published in 1977 by Springer-Verlag, at page 279. In this pump the vent hole in the sealing surface between beginning and end of the side channel is a circular bore. The outlet opening is relatively small and extends radially over about the inner half of the width of the side channel.

It has been shown in practice that the known supply pump does not meet the requirements when it is used to supply easily volatile fuel, for example, gasoline, which has a higher temperature. In this case so much gas develops in the fuel that the necessary supply quantity is not reached and it takes an excessive amount of time from the starting of the pump to the point of time when it supplies the maximum quantity.

It is an object of the invention to develop a fuel supply pump comprising the features of the known pumps in such a way that the supply quantity is increased at higher temperatures. The higher temperature the fuel can have in a motor vehicle tank would for example be a temperature on the order of 60 degrees Celsius.

SUMMARY OF THE INVENTION

This problem is solved according to the present invention in that in a fuel supply pump having an outlet opening which has two areas extending across a finite angle and adjacent to each other in the circumferential direction, which areas have radially differing widths, and which extend farther into the sealing surface with the narrower area extending externally rather than internally. With a design of this type a larger supply quantity can be achieved.

A preferred embodiment is provided in which the vent hole is an oblong hole which in the circumferential direction has a larger extension than in the radial direction. A favorable position of the vent hole is achieved and the invention gives rise to the availability and the arrangement of a further vent hole. By further developments according to the present invention the quantity of the fuel supplied is increased further. Other embodiments relate to advantageous developments of the shape of the pump chamber, which have an effect on the width of the annular gap between the impeller and an axial wall of the pump chamber. The narrowness of the annular gap contributes in a special way to press out from the pump chamber liquid through the outlet opening and gas through the vent hole or through the vent holes.

For efficiency, the pump chamber is formed of two parts, these parts occupy an exact and firm position relative to each other. This is advantageously achieved in that one part rests upon a shoulder of the other part, which shoulder is at least in sections surrounded by a centering collar which has jamming ribs slantingly rising towards the shoulder. These jamming ribs center one part on the other in a firm position. This is particularly important in the first instance when the impeller is mounted in one part and the axial wall of the pump chamber is positioned at the other part. This axial wall has an area for sealing purposes between beginning and end of the side channel in which the width of the annular gap between impeller and axial wall is practically zero. By exactly centering the two parts to each other the width of the annular gap can be kept constant.

In a preferred embodiment the cross-section of one side channel is a segment of a circle and the proportion of the length of the chord to the height of the segment of the circle is preferably about 0.3. It is also advantageous if the wings of the impeller are reinforced by accumulation of material at their end mountings on a hub of the impeller. Some of the wings have a greater accumulation of material than others. Behind the greater accumulations of material there can be knock-outs of the injection-molding die. The parts forming the pump chamber are preferably made of a duroplastic synthetic material and the impeller of a thermoplastic synthetic material.

BRIEF DESCRIPTION OF THE DRAWING

The invention will now be described in detail in conjunction with the accompanying drawing in which.

DETAILED DESCRIPTION

Figure 1:
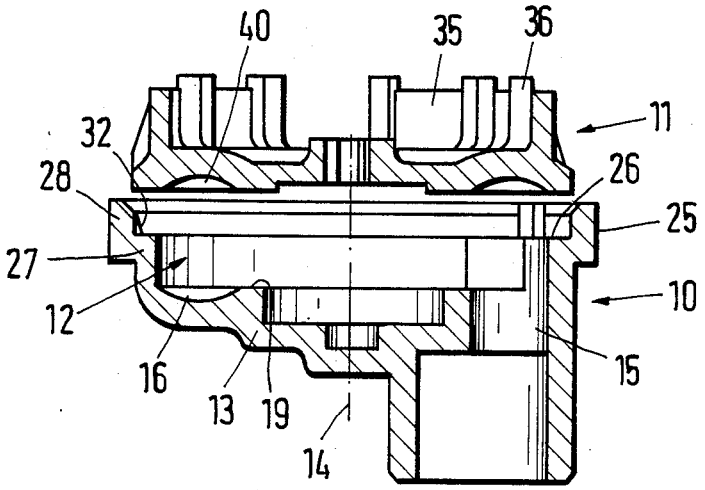
FIG. 1 is a longitudinal section through a pump chamber formed by a top part and a bottom part, wherein the two parts are shown axially spaced from each other.

The pump bottom 10 which forms a pump chamber 12 together with a pump top 11 is cup shaped. Spaced from its center line 14, which is the center line of the pump chamber 12 and of the pump top 11, its bottom 13 has a circular inlet opening 15 for the pumping medium. From the inlet opening 15 originates an annular side channel 16, which is incorporated in the bottom 13 and whose cross-section is almost everywhere a segment of a circle. The latter fact can in particular be clearly seen in FIG. 1. The proportion of the length of the chord to the height of the segment of the circle, thus the proportion of width to depth of the side channel 16, is approximately 0.3. The width of the side channel 16 corresponds to the diameter of the inlet opening 15.

Starting from the center of the inlet opening 15 the side channel 16 extends over an angle of 315 degrees. Shortly in front of its end 18 it has a vent hole 17 penetrating the bottom 13. Between the end 18 of the side channel 16 and the inlet opening 15 a sealing surface 20 is positioned at the same level as an axial wearing ring 19 for the impeller.

In the generated surface 15 of the cup shaped pump bottom 10 there is a circumferential step 25, so that axially one behind the other two areas 27 and 28 of the generated surface 25 are formed. The area 27 limits the pump chamber 12 in the radial direction and determines by its internal radius in particular angular areas the radius of the pump chamber in these areas. As can be readily seen from FIG. 2 the radius of the pump chamber 12 is smallest in the area of the sealing surface 20. The internal radius of the portion 29 of that place of the area 27 is slightly larger than the radius of the impeller.

At the end 18 of the side channel 16 the portion 29 is adjoined by a portion 30 extending over an angle of 30 degrees, whose internal radius is slightly larger than that of the portion 29. The rest of the angular area is occupied by a portion 31 with even larger internal radius. Because the internal radius of the portion 29 corresponds approximately to the radius of the impeller, it can be seen that between the portions 31 and 30 and the impeller there is an annular gap when the impeller is in the pump chamber. It can be seen that the width of the annular gap at the portion 30 amounts to about one third of the width of the portion 31.

The step 26 serves as a supporting shoulder for the pump top 11. The area 28 of the generated surface 25 forms a centering collar for the pump top 11. In order to achieve an accurate centering free from play the centering collar 28 is provided with jamming ribs 32 slantingly rising towards the supporting shoulder 26. On the whole the pump top is a disk on whose side not facing the pump chamber 12 is formed a collar 35 with individual centering pins 36. On the collar 35 can be put a housing of an electric motor driving the impeller.

A side channel 40 is incorporated in the inside of the pump top 11, which side channel with its axial and radial dimensions is in line with the corresponding dimensions of the side channel 16 in the angular area of the portion 31 of the generated surface 25. The side channel 40 begins axially above the inlet opening 15 and extends over an angle of about 270 degrees. It is followed by an outlet opening 41 for the pumping medium, which is composed of two portion 42 and 43 and as a whole extends over an angle of 45 degrees. The portion 42 directly following the side channel 40 in its radial width corresponds to the width of the side channel 40 and in the circumferential direction extends over an angle of about 25 degrees. Its internal and external diameters are in line with those of the side channel 40.

The portion 42 of the outlet opening 41 is adjoined by the narrower portion 43, whose external diameter is in line with that of the portion 42, which however is only half as broad radially as the portion 42. In the circumferential direction the portion 43 of the outlet opening 41 extends over an angle of about 20 degrees. Between the entry 44 of the side channel 40 and the outlet opening 41 there is similarly as in the case of the pump bottom 10 a sealing surface 45. As far as its level is concerned the sealing surface 45 is positioned somewhat higher than the axial stop ring 46 for the impeller, so that the wings of the impeller do not hit it.

In the sealing surface 45 there is an oblong hole 47 which serves as a vent hole for the pump chamber 12 just as the hole 17 in the pump bottom 10. The oblong hole is positioned in such a way that with its larger extension it lies in the circumferential direction. In the radial direction it is approximately half as broad as the side channel 40 and the portion 42 of the outlet opening 41 respectively. Radially seen it is furthermore completely within the portion 43 of the outlet opening 41 and begins there, where the portion 43 ends and extends away from the latter into the sealing surface 45.

Figure 2:
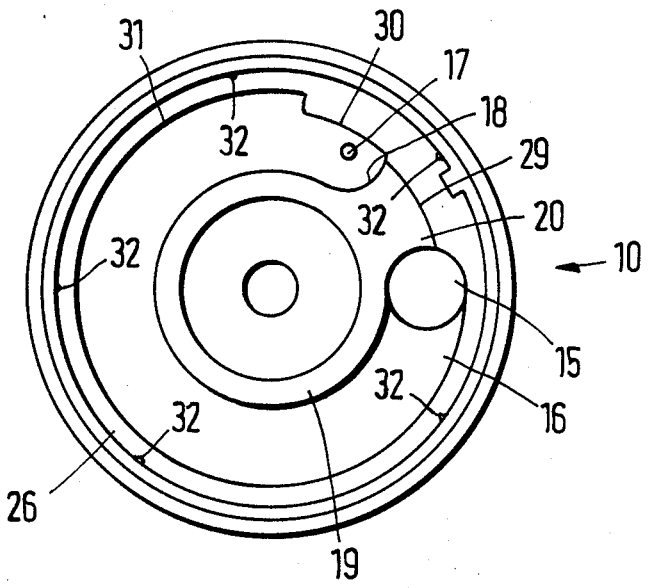
FIG. 2 is an interior view of the pump bottom in the axial direction.
Figure 3:
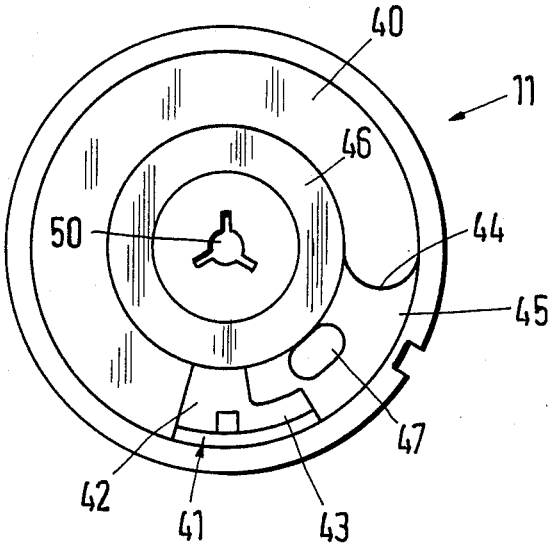
FIG. 3 is an interior view of the pump top in the axial direction.
Figure 4:
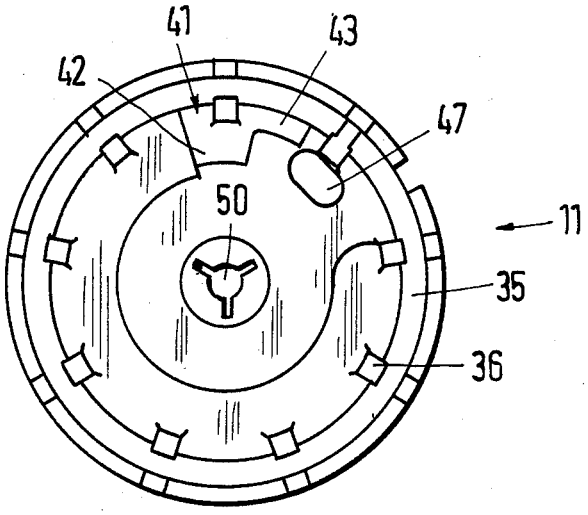
FIG. 4 is an external view of the pump top in the axial direction.

By reference of FIGS. 2 and 4 it can be seen that, in the axial direction, the vent hole 17 in the pump bottom 10 is positioned in the vicinity of the vent hole 47 in the pump top 11 and approximately at the end of the narrow area 43 of the outlet opening 41.

Figure 5:
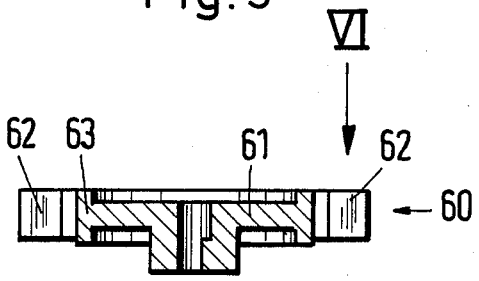
FIG. 5 is an axial section through the impeller.

The pump top 11 has a central bore 50 through which a drive shaft (not shown in detail) of the electric motor mentioned projects into the pump chamber 12 and there an impeller is mounted in a manner protected against twisting. This has been shown in detail in FIGS. 5 and 6. The impeller 60 has a hub 61 and a total of 18 wings 62, which are uniformly distributed over the circumference of the hub and formed on it in a radially projecting manner. The wings 62 are indeed formed onto an outer ring 63 of the hub 61, which in the axial direction projects on both sides beyond the inner area of the hub 61. As can be seen from FIG. 5 the wings 62 are flush at one side with the axial front side of the ring 63, while at the other side they are slightly set off backwards in relation to the corresponding side of the ring 63. During operation the ring 63 of the impeller can hit the ring 19 of the pump bottom 10 and the ring 46 of the pump top 11 respectively. The setting off in a backwards direction of the wings 62 relative to the ring 63 on one side prevents the wings from hitting the sealing surface 20 positioned at the same level as the ring 19. At the other side a setting off between the ring 63 and the wings 62 is not necessary, because the sealing surface 45 of the pump top 11 is positioned at a higher level than the ring 46.

Figure 6:
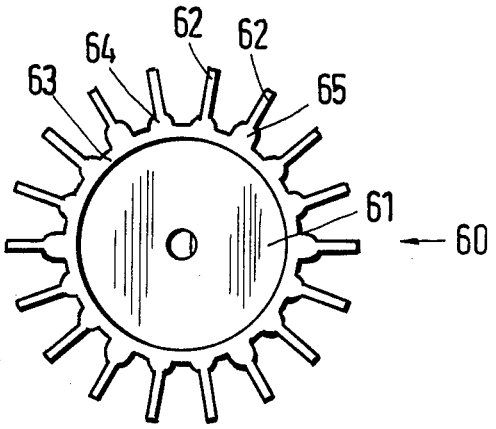
FIG. 6 is a top view on the impeller in the direction of arrow VI of FIG. 5.

As FIG. 6 clearly shows the wings 62 of the impeller 60 are reinforced by accumulations of material 64 or 65 at their ends mounted on the hub 61. These accumulations of material are outwardly curved as seen from a wing 62. The accumulation of material 65 of every third wing is bigger than the accumulation of material 64 of the two following wings 62. Upon the bigger accumulations of material 65 a knockout of the injection-mounting die can act, so that the impeller can be removed from the injection-moulding die without being damaged.

The impeller 60 is made of a thermoplastic synthetic material. In contrast thereto the pump bottom 10 and the pump top 11 consist of a duroplastic synthetic material. A synthetic material of this kind is well suited for a production of accurately dimensioned pump chamber parts. On the other hand due to the combination of a duroplastic and of a thermoplastic synthetic material, the noise development is kept at a low level and a longer service life is achieved.

What is claimed is:

1. A fuel supply pump for volatiling fuel, comprising an inlet opening (15) to a pump chamber (12), an impeller (60) in the pump chamber (12) and a side channel (40) on whose end an outlet opening (41) is provided, said outlet opening (41) being separated from the entry (44) of the side channel (40) by a sealing surface (45) with a vent hole (47), wherein the outlet opening (41) has two areas, including a broader area (42) and a narrower area (43) extending across a finite angle and being adjacent to each other in the circumferential direction, said areas having radially differing widths, and with the narrower area (43) extending externally farther into the sealing surface (45) than internally.

2. A fuel supply pump according to claim 1, wherein the outlet opening (41) externally extends over an angle of about 45 degrees.

3. A fuel supply pump according to claim 2, wherein the outlet opening (41) internally extends over an angle of about half the size of that outside.

4. A fuel supply pump according to claim 3, wherein the narrower area (43) of the outlet opening (41) is about half as broad as the broader area (42).

5. A fuel supply pump according to claim 4, wherein the outlet opening (41) in its broad area (42) is at least substantially as broad as the side channel (40).

6. A fuel supply pump according to claim 5, wherein the vent hole (47) is an oblong hole which in the circumferential direction has a larger extension than in the radial direction.

7. A fuel supply pump according to claim 6, wherein the radially and internally positioned vent hole (47) in the circumferential direction begins approximately where the narrower area (43) of the outlet opening (41) ends.

8. A fuel supply pump according to claim 7, wherein axially there is a further vent hole (17) at least in the vicinity of the vent hole (47) at the other side of the impeller (60), and wherein the further vent hole (17) is at least substantially positioned at the end of the narrow area (43) of the outlet opening (41).

9. A fuel supply pump according to claim 8, wherein the annular gap between the impeller and an axial wall (25) of the pump chamber (12) is narrower adjacent to a first portion (30) of the axial wall (25), said first portion (30) being adjacent to a second portion (29) of the axial wall (25), said second portion (29) having a radius which substantially corresponds to the radius of the impeller (60).

10. A fuel supply pump according to claim 9, wherein the widths of the annular gap in the portion (30) is approximately one third of the width of the rest of the annular gap.

11. A fuel supply pump according to claim 10, wherein the narrower portion (30) extends to the end of the entry-sided side channel (16) and preferably over an angle of 30 degrees.

12. A fuel supply pump according to claim 11, wherein the pump chamber (12) is substantially formed by two parts (10, 11) of which one part (11) rests upon a shoulder (26) of the other part (10), which shoulder is at least in sections surrounded by a centering collar (28), and that the centering collar has jamming ribs (32) slantingly rising towards the shoulder (26).

13. A fuel supply pump according to claim 12, wherein the cross-section of at least one side channel (16, 40) is a segment of a circle and preferably the proportion of the length of the chord to the height of the segment of the circle is approximately 0.3.

14. A fuel supply pump according to claim 13, wherein the wings (62) of the impeller (60) are reinforced by an accumulation of material (64, 65) at their end mountings on a hub (61) of the impeller (60), and wherein the accumulation of material (64, 65), seen from a wing (62), is outwardly curved.

15. A fuel supply pump according to claim 14, wherein the accumulation of material (65) on some of the wings (62) is greater than on others.

16. A fuel supply pump according to claim 15, wherein between the wings (62) with a greater accumulation of material there is the same number of wings (62) with a smaller accumulation of material (64).

17. A fuel supply pump according to claim 16, wherein the parts (10, 11) forming the pump chamber (12) are molded of a duroplastic synthetic material and the impeller (60) of a thermoplastic synthetic material.

* * * * *